US012221916B2

(12) United States Patent
Billich et al.

(10) Patent No.: US 12,221,916 B2
(45) Date of Patent: Feb. 11, 2025

(54) HYDRAULIC OPERATING DEVICE FOR A COOLING FAN OF A UTILITY VEHICLE

(71) Applicant: DEERE & COMPANY, Moline, IL (US)

(72) Inventors: Manuel Billich, Dischingen (DE); Michael Meid, Waghaeusel (DE)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 18/307,185

(22) Filed: Apr. 26, 2023

(65) Prior Publication Data

US 2023/0358160 A1 Nov. 9, 2023

(30) Foreign Application Priority Data

May 3, 2022 (DE) ..... 102022110886.4

(51) Int. Cl.
*F01P 5/04* (2006.01)
*F01P 7/04* (2006.01)

(52) U.S. Cl.
CPC ..... *F01P 7/044* (2013.01)

(58) Field of Classification Search
CPC ..... F01P 5/04; F01P 3/20; F01P 7/044
USPC ..... 60/452, 456
See application file for complete search history.

(56) References Cited

U.S. PATENT DOCUMENTS 6,314,729 B1 * 11/2001 Crull ..... F01P 7/044 60/452
6,848,255 B2 * 2/2005 Chiaramonte ..... F01P 7/044 60/456
8,863,508 B2 10/2014 Nelson et al.
9,127,697 B1 * 9/2015 Throckmorton ..... F15B 11/162
2006/0196179 A1 9/2006 Kesavan et al.
2013/0243611 A1 * 9/2013 Rill ..... F04B 1/26 417/364
2022/0056833 A1 2/2022 Tanaka et al.

FOREIGN PATENT DOCUMENTS

DE 102007058534 A1 6/2009

OTHER PUBLICATIONS

European Search Report issued in application No. 23168158.6, dated Sep. 22, 2023, 6 pages.

* cited by examiner

*Primary Examiner* — Kenneth Bomberg
*Assistant Examiner* — Daniel S Collins

(57) ABSTRACT

A hydraulic operating device for a cooling fan of a utility vehicle includes a hydraulic motor and a fan assembly, which can be driven by the hydraulic motor for generating a cooling air stream. A hydraulic supply is adjustable in terms of its delivery volume in accordance with pressure feedback for providing pressurized hydraulic liquid. A control valve for setting, in a manner dependent on a control signal that represents a cooling demand, a volume flow that passes through the hydraulic motor, with a sensor line that is branched off in a supply line between the control valve and the hydraulic motor leading to a pressure control inlet of the hydraulic supply.

13 Claims, 2 Drawing Sheets

HYDRAULIC OPERATING DEVICE FOR A COOLING FAN OF A UTILITY VEHICLE

CROSS-REFERENCE TO RELATED APPLICATIONS

This application claims priority to German Patent Application No. 102022110886.4, filed May 3, 2022, which is hereby incorporated by reference.

FIELD OF THE DISCLOSURE

The disclosure relates to a hydraulic operating device for a cooling fan of a utility vehicle.

BACKGROUND

Agricultural or industrial utility vehicles have cooling fans for generating cooling air streams.

SUMMARY

An operating device is used inter alia in agricultural tractors from the manufacturer John Deere for the purposes of cooling charge air which has been compressed by a turbocharger and which is to be fed to a supercharged diesel engine. The operating device that is known in this respect has a hydraulic motor that drives a fan impeller for the purposes of generating an axial air stream that passes through a charge-air cooler. The hydraulic motor is operated by a hydraulic pump with constant delivery volume, which hydraulic pump can be provided for this purpose. In order, in such a case, to be able to adapt the rotational speed of the fan impeller and thus the intensity of the axial air stream to the respective cooling demand, a bypass valve in the form of an electrically controllable pressure control valve is connected in parallel with respect to the hydraulic motor. The arrangement thus created makes it possible for the charge-air cooler to be accommodated flexibly within the agricultural tractor, and therefore allows improved utilization of the structural space that is thus available.

In addition to this, agricultural tractors are commonly also equipped with a (main) hydraulic system that serves for operating various vehicle-related and work-related functions. The hydraulic system itself comprises a hydraulic pump in the form of a hydraulic variable-displacement pump, which is fed from a reservoir for hydraulic liquid. The hydraulic variable-displacement pump has a pressure control inlet, which makes it possible for the delivery volume to be set as desired in accordance with a fed-back hydraulic pressure.

The presence of two hydraulic pumps naturally leads to an increased structural space requirement within the agricultural tractor. Furthermore, the use of a hydraulic pump with a constant delivery volume, which is common for cost reasons, inevitably gives rise to compromises in terms of energy efficiency, which applies for example to the case of part-load operation of the hydraulic motor.

It is therefore an object of the present disclosure to configure a hydraulic operating device for a cooling fan of a utility vehicle with a view to optimizing the required structural space and the energy efficiency.

This object is achieved by a hydraulic operating device having the features of one or more of the following embodiments.

The hydraulic operating device for a cooling fan of a utility vehicle comprises a hydraulic motor and a fan assembly, which can be driven by the hydraulic motor, for generating a cooling air stream, a hydraulic supply, which is adjustable in terms of its delivery volume in accordance with pressure feedback, for providing pressurized hydraulic liquid, and a control valve for setting, in a manner dependent on a control signal that represents a cooling demand, a volume flow that passes through the hydraulic motor, with a sensor line that is branched off in a supply line between control valve and hydraulic motor leading to a pressure control inlet, provided for pressure feedback purposes, of the hydraulic supply.

To adapt the rotational speed of the hydraulic motor and thus the cooling power of the fan assembly, the control valve is opened or closed in a manner dependent on the control signal, which leads to a corresponding increase or decrease of the volume flow that passes through the hydraulic motor. The change in the hydraulic pressure that occurs here in the supply line is fed back via the sensor line to the pressure control inlet of the hydraulic supply, whereupon the hydraulic supply reacts with a corresponding increase or decrease of the delivery volume.

This leads to operation of the fan assembly which is adapted to the actual cooling requirement and which is thus particularly efficient.

The cooling air stream generated by the fan assembly passes, for example, through a charge-air cooler which serves for cooling charge air which has been compressed by a turbocharger and which is to be fed to a supercharged diesel engine. The fan assembly is configured here as an axial or radial fan.

In the sensor line that is provided for load signaling, there may be situated a throttle element which is configured as a constant throttle and which is in the form of an orifice or nozzle and which limits hydraulic losses in the direction of the pressure control inlet of the hydraulic supply to non-critical values. Depending on the specific configuration of the hydraulic system, the throttle element may however also be omitted.

In principle, the operating device according to the disclosure lends itself to use in all utility vehicles which are equipped with a hydraulic system for operating various vehicle-related or work-related functions and which have a hydraulic supply (formed for example by a hydraulic variable-displacement pump) for this purpose. This applies not only to agricultural tractors but also to most other utility vehicles from the agricultural and forestry sector or from the construction machine sector. Under such circumstances, the need for a separate hydraulic pump is eliminated.

Advantageous embodiments of the operating device are disclosed herein.

The control valve can be a 2/2 directional proportional valve. The 2/2 directional proportional valve may be of electrical or pressure-actuated design. Accordingly, electric valve actuation by a solenoid or stepper motor associated with the 2/2 directional proportional valve, or else hydraulic valve actuation by introduction of a pilot pressure into a pressure control inlet of the 2/2 directional proportional valve, may be provided on the basis of the control signal. The pilot pressure is generated by a pilot valve which is electrically actuatable in a manner dependent on the control signal and which is situated between the hydraulic supply and the pressure control inlet of the 2/2 directional proportional valve.

It is furthermore possible for the control valve to be of pressure-compensated configuration. Owing to the pressure compensation, the control valve keeps the volume flow specified in accordance with the control signal, and thus the rotational speed of the fan assembly, substantially constant even in the event of load fluctuations of the hydraulic motor and/or in the event of operational pressure fluctuations of the hydraulic supply.

In the sensor line, there may be arranged a one-way or non-return valve which allows flow to pass through in the direction of the pressure control inlet of the hydraulic supply. This prevents undesired rotational speed fluctuations of the fan assembly owing to pressure reactions that are caused at the pressure control inlet of the hydraulic supply owing to superposed load signals from further hydraulic consumers.

In the sensor line, instead of a one-way or non-return valve, there may also be arranged a pressure-limiting valve which opens in the direction of the pressure control inlet of the hydraulic supply. The pressure-limiting valve behaves in the manner of a one-way or non-return valve with regard to avoiding undesired pressure reactions via the sensor line, but additionally reduces the hydraulic pressure that is fed back to the pressure control inlet of the hydraulic supply by an amount corresponding to the respective switching threshold of the pressure-limiting valve. This ultimately simulates a reduced hydraulic load for the hydraulic supply, which, with suitable design of the hydraulic motor, makes it possible to achieve an additional improvement in energy efficiency without impairment of the cooling power that can be imparted by the fan assembly.

The above and other features will become apparent from the following detailed description and accompanying drawings.

BRIEF DESCRIPTION OF THE DRAWINGS

The hydraulic operating device according to the disclosure for a cooling fan of a utility vehicle will be described in more detail below on the basis of the appended drawings. Here, identical reference designations relate to corresponding components or components which are of comparable function. In the drawings.

DETAILED DESCRIPTION

The embodiments or implementations disclosed in the above drawings and the following detailed description are not intended to be exhaustive or to limit the present disclosure to these embodiments or implementations.

Figure 1:
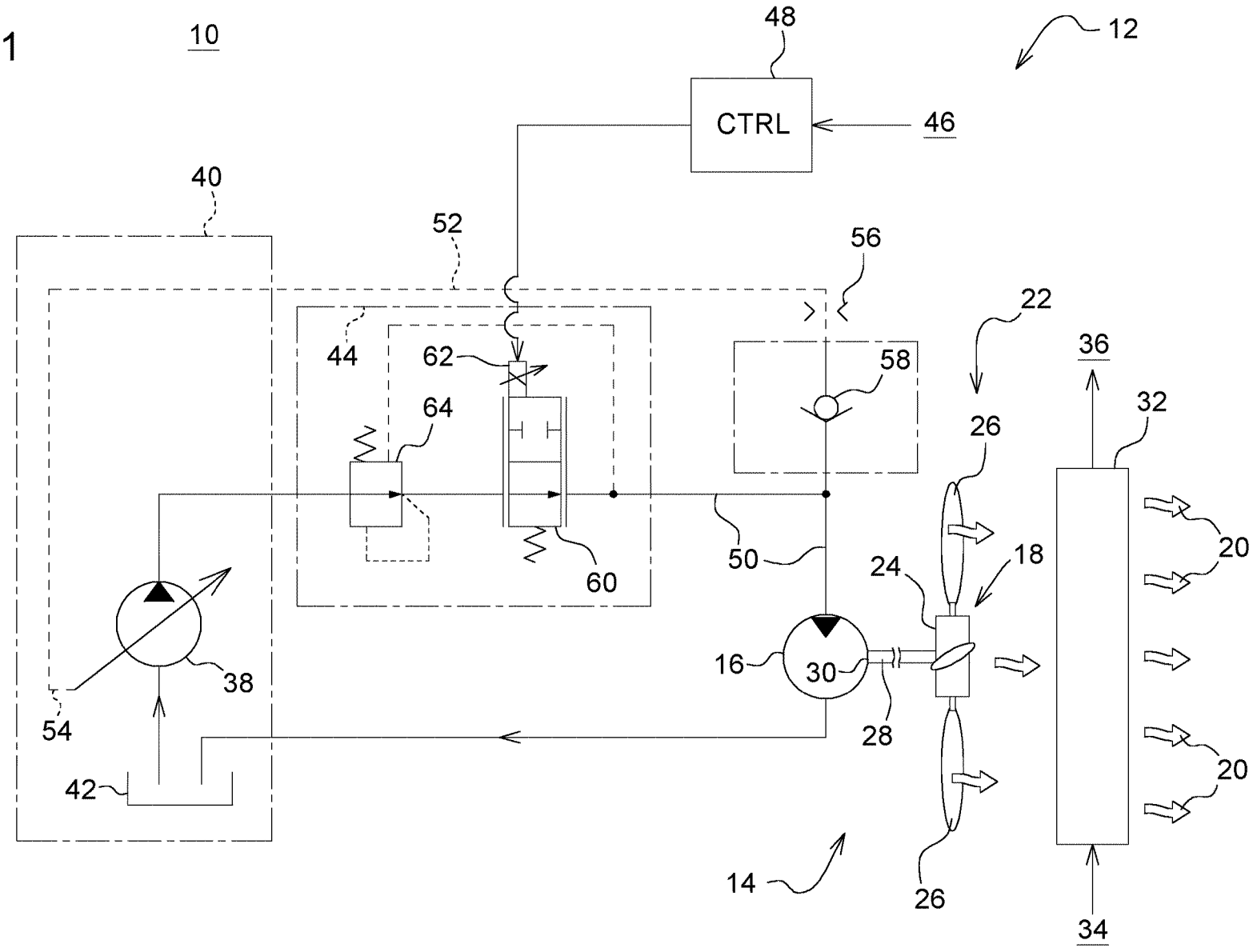
FIG. 1 shows a schematic illustration of a first exemplary embodiment of the hydraulic operating device according to the disclosure.

FIG. 1 shows, in a simplified illustration, a schematic diagram of the hydraulic operating device according to the disclosure according to a first exemplary embodiment.

The hydraulic operating device 12, situated in a utility vehicle 10, for a cooling fan 14 comprises a hydraulic motor 16 and a fan assembly 18, which can be driven by the hydraulic motor 16, for generating a cooling air stream 20. The fan assembly 18 is configured as an axial fan 22 in the example, but may also, in a departure from this, be a radial fan. The axial fan 22 has multiple projecting fan blades 26 along an outer circumference of a fan hub 24, the fan hub 24 being connected via a drive shaft 28 to an output 30 of the hydraulic motor 16. Here, fan assembly 18 and hydraulic motor 16 in combination with one another form the cooling fan 14.

The cooling air stream 20 generated by the fan assembly 18 passes, in the present case, through a charge-air cooler 32 which serves for cooling charge air which has been compressed by a turbocharger 34 and which is to be fed to a supercharged diesel engine 36.

The operating device 12 furthermore comprises a hydraulic supply, formed by a hydraulic variable-displacement pump 38, for providing pressurized hydraulic liquid. The hydraulic variable-displacement pump 38 draws the hydraulic liquid in from a reservoir 42.

The hydraulic variable-displacement pump 38 is part of a (main) hydraulic system 40 of the utility vehicle 10 and serves there for operating various vehicle-related and work-related functions. The utility vehicle 10 is for example an agricultural tractor or any other utility vehicle from the agricultural and forestry sector or from the construction machine sector.

A control valve 44 serves for setting, in a manner dependent on a control signal that represents a cooling demand 46, a volume flow that passes through the hydraulic motor 16. The (in the present case electrical) control signal is generated by a control unit 48 (e.g., a controller including a processor and memory), which serves for monitoring a cooling demand required by the charge-air cooler 32.

Furthermore, a sensor line 52 that is branched off in a supply line 50 between control valve 44 and hydraulic motor 16 leads to a pressure control inlet 54, which serves for pressure feedback purposes, of the hydraulic variable-displacement pump 38.

To adapt the rotational speed of the hydraulic motor 16 and thus the cooling power of the fan assembly 18, the control valve 44 is opened or closed in a manner dependent on the control signal, which leads to a corresponding increase or decrease of the volume flow that passes through the hydraulic motor 16. The change in the hydraulic pressure that occurs here in the supply line 50 is fed back via the sensor line 52 to the pressure control inlet 54 of the hydraulic variable-displacement pump 38, whereupon the hydraulic variable-displacement pump reacts with a corresponding increase or decrease of the delivery volume.

As per FIG. 1, in the sensor line 52 that is provided for load signaling, there is situated a throttle element 56 which is configured as a constant throttle and which is in the form of an orifice or nozzle and which limits hydraulic losses in the direction of the pressure control inlet 54 of the hydraulic variable-displacement pump 38 to non-critical values. Depending on the specific configuration of the hydraulic system 40, the throttle element 56 may however also be omitted.

In the sensor line 52, there is furthermore arranged a one-way or non-return valve 58 which allows flow to pass through in the direction of the pressure control inlet 54 of the hydraulic variable-displacement pump 38. The valve is situated within the sensor line 52 in series with respect to the throttle element 56. The one-way or non-return valve 58 prevents undesired rotational speed fluctuations of the fan assembly 18 owing to pressure reactions that are caused at the pressure control inlet 54 of the hydraulic variable-displacement pump 38 owing to superposed load signals from further hydraulic consumers.

In the example, the control valve 44 is a 2/2 directional proportional valve 60, which can be actuated electrically by an associated solenoid 62 on the basis of the control signal generated by the control unit 48.

The control valve 44 is of pressure-compensated configuration. For this purpose, a pressure control valve 64 is situated between hydraulic variable-displacement pump 38 and 2/2 directional proportional valve 60, which pressure control valve compares an outlet-side hydraulic pressure with an inlet-side hydraulic pressure at the 2/2 directional proportional valve 60 and sets the outlet-side hydraulic pressure to a fixed differential pressure. In this way, the 2/2 directional proportional valve 60 keeps the volume flow specified in accordance with the control signal, and thus the rotational speed of the fan assembly 18, substantially constant even in the event of load fluctuations of the hydraulic motor 16 and/or in the event of operational pressure fluctuations of the hydraulic supply. The pressure control valve 64 may, together with the 2/2 directional proportional valve 60, be a structural part of the control valve 44.

If the demands on the constancy of the cooling power are relatively low, it is also possible for pressure compensation to be omitted, and the additional pressure control valve 64 is then eliminated.

In the example, in order to realize fail-safe operation, the 2/2 directional proportional valve 60 is configured such that, in the event of a fault of the control unit 48, the valve automatically assumes a fully open position and thus maintains the required cooling of the charge-air cooler 32. In a departure from this, it is however also possible for the 2/2 directional proportional valve 60 to be preloaded in the direction of a closed position, such that the operation of the hydraulic motor 16 is intentionally interrupted in the event of a failure of the control unit 48. A correspondingly designed 2/2 directional proportional valve 60 is shown representatively in FIG. 2.

Figure 2:
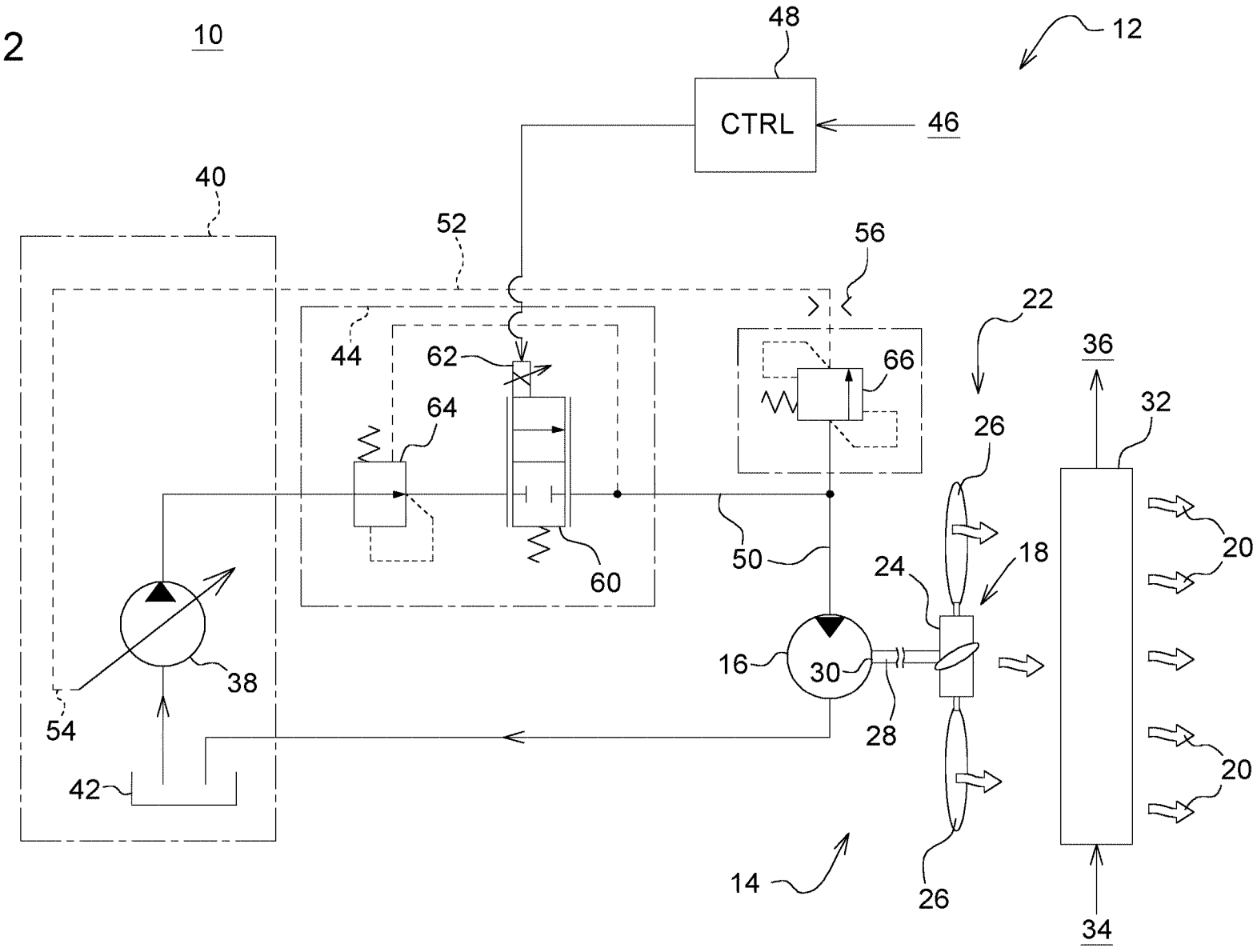
FIG. 2 shows a schematic illustration of a second exemplary embodiment of the hydraulic operating device according to the disclosure.

FIG. 2 shows, in a simplified illustration, a schematic diagram of the hydraulic operating device according to the disclosure according to a second exemplary embodiment. Aside from the abovementioned different configuration of the 2/2 directional proportional valve 60, the second exemplary embodiment also differs from the first exemplary embodiment shown in FIG. 1 in that, in the sensor line 52, a pressure-limiting valve 66 which opens in the direction of the pressure control inlet 54 of the hydraulic variable-displacement pump 38 is arranged instead of a one-way or non-return valve 58. The pressure-limiting valve 66 behaves in the manner of a one-way or non-return valve with regard to avoiding undesired pressure reactions via the sensor line 52, but additionally reduces the hydraulic pressure that is fed back to the pressure control inlet 54 by an amount corresponding to the respective switching threshold of the pressure-limiting valve. This ultimately simulates a reduced hydraulic load for the hydraulic variable-displacement pump 38, which, with suitable design of the hydraulic motor 16, makes it possible to achieve an additional improvement in energy efficiency without impairment of the cooling power that can be imparted by the fan assembly 18.

The terminology used herein is for the purpose of describing example embodiments or implementations and is not intended to be limiting of the disclosure. As used herein, the singular forms "a," "an," and "the" are intended to include the plural forms as well, unless the context clearly indicates otherwise. It will be further understood that the any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof.

Those having ordinary skill in the art will recognize that terms such as "above," "below," "upward," "downward," "top," "bottom," etc., are used descriptively for the figures, and do not represent limitations on the scope of the present disclosure, as defined by the appended claims. Furthermore, the teachings may be described herein in terms of functional and/or logical block components or various processing steps, which may include any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described embodiments or implementations.

As used herein, "e.g.," is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example embodiments or implementations of the present disclosure, these descriptions should not be viewed in a restrictive or limiting sense. Rather, there are several variations and modifications which may be made without departing from the scope of the appended claims.

What is claimed is:

1. A hydraulic operating device for a cooling fan of a utility vehicle, comprising:

a hydraulic motor;

a fan assembly, which can be driven by the hydraulic motor for generating a cooling air stream;

a hydraulic supply, which is adjustable in terms of its delivery volume in accordance with pressure feedback, for providing pressurized hydraulic liquid; and a control valve for setting, in a manner dependent on a control signal that represents a cooling demand, a volume flow that passes through the hydraulic motor, with a sensor line that is branched off in a supply line between the control valve and the hydraulic motor leading to a pressure control inlet of the hydraulic supply;

wherein, in the sensor line, there is arranged a pressure-limiting valve which opens in the direction of the pressure control inlet of the hydraulic supply and which is responsive to pressure feedback; and wherein, in the sensor line, there is also arranged a throttle element which is configured as a constant throttle and which is in the form of an orifice or nozzle.

2. The operating device of claim 1, wherein the control valve is a 2/2 directional proportional valve.

3. The operating device of claim 1, wherein the control valve is pressure-compensated.

4. The operating device of claim 1, wherein the throttle element is in series with respect to the pressure-limiting valve.

5. The operating device of claim 1, wherein the pressure-limiting valve is configured to reduce the hydraulic pressure that is fed back to the pressure control inlet by an amount corresponding to a respective switching threshold of the pressure-limiting valve.

6. A hydraulic operating device for a cooling fan of a utility vehicle, comprising:

a hydraulic motor;

a fan assembly, which can be driven by the hydraulic motor for generating a cooling air stream;

a hydraulic supply, which is adjustable in terms of its delivery volume in accordance with pressure feedback, for providing pressurized hydraulic liquid; and a control valve for setting, in a manner dependent on a control signal that represents a cooling demand, a volume flow that passes through the hydraulic motor, with a sensor line that is branched off in a supply line between the control valve and the hydraulic motor leading to a pressure control inlet of the hydraulic supply;

wherein the control valve is a 2/2 directional proportional valve and is pressure-compensated; and wherein, in the sensor line, there is arranged a pressure-limiting valve which opens in the direction of the pressure control inlet of the hydraulic supply and which is responsive to pressure feedback;

wherein, in the sensor line, there is also arranged a throttle element which is configured as a constant throttle and which is in the form of an orifice or nozzle.

7. The operating device of claim 6, wherein the throttle element is in series with respect to the pressure-limiting valve.

8. The operating device of claim 6, wherein the pressure-limiting valve is configured to reduce the hydraulic pressure that is fed back to the pressure control inlet by an amount corresponding to a respective switching threshold of the pressure-limiting valve.

9. A utility vehicle comprising:

a hydraulic motor;

a fan assembly, which can be driven by the hydraulic motor for generating a cooling air stream;

a hydraulic supply, which is adjustable in terms of its delivery volume in accordance with pressure feedback, for providing pressurized hydraulic liquid; and a control valve for setting, in a manner dependent on a control signal that represents a cooling demand, a volume flow that passes through the hydraulic motor, with a sensor line that is branched off in a supply line between the control valve and the hydraulic motor leading to a pressure control inlet of the hydraulic supply;

wherein, in the sensor line, there is arranged a pressure-limiting valve which opens in the direction of the pressure control inlet of the hydraulic supply and which is responsive to pressure feedback;

wherein, in the sensor line, there is also arranged a throttle element which is configured as a constant throttle and which is in the form of an orifice or nozzle.

10. The operating device of claim 9, wherein the control valve is a 2/2 directional proportional valve.

11. The operating device of claim 9, wherein the control valve is pressure-compensated.

12. The operating device of claim 9, wherein the throttle element is in series with respect to the pressure-limiting valve.

13. The operating device of claim 9, wherein the pressure-limiting valve is configured to reduce the hydraulic pressure that is fed back to the pressure control inlet by an amount corresponding to a respective switching threshold of the pressure-limiting valve.

* * * * *